US009962931B2

(12) United States Patent
Sender Beleta et al.

(10) Patent No.: US 9,962,931 B2
(45) Date of Patent: May 8, 2018

(54) ESTIMATION OF PEN TO PAPER SPACING

(71) Applicant: HEWLETT-PACKARD DEVELOPMENT COMPANY, L.P., Houston, TX (US)

(72) Inventors: Jordi Sender Beleta, Barcelona (ES); Montserrat Sorano Pallarol, Sant Cugat del Valles (ES); Marcos Casaldaliga Albisu, Sant Cugat del Valles (ES); M. Isabel Borrell Bayona, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/544,062

(22) PCT Filed: Feb. 18, 2015

(86) PCT No.: PCT/US2015/016433

§ 371 (c)(1),
(2) Date: Jul. 17, 2017

(87) PCT Pub. No.: WO2016/133507

PCT Pub. Date: Aug. 25, 2016

(65) Prior Publication Data

US 2017/0368855 A1 Dec. 28, 2017

(51) Int. Cl.

| | |
|---|---|
| ***B41J 29/393*** | (2006.01) |
| ***B41J 2/045*** | (2006.01) |
| ***B41J 2/21*** | (2006.01) |

(52) U.S. Cl.

CPC ..... *B41J 2/04556* (2013.01); *B41J 2/04558* (2013.01); *B41J 2/2146* (2013.01)

(58) Field of Classification Search

CPC ..... B41J 2/04556; B41J 2/2146

See application file for complete search history.

(56) References Cited

U.S. PATENT DOCUMENTS

| | | | |
|---|---|---|---|
| 5,510,815 | A | 4/1996 | Linder et al. |
| 6,196,652 | B1 | 3/2001 | Subirada et al. |

(Continued)

FOREIGN PATENT DOCUMENTS

| | | | |
|---|---|---|---|
| EP | 0622237 | A2 | 11/1994 |
| EP | 1029697 | A1 | 8/2000 |
| EP | 1201432 | A1 | 10/2014 |

OTHER PUBLICATIONS

Hewlett-Packard Company, "Service and Support Manual," HP Business Inkjet 3000 3000n, Sep. 23, 2002. http://www.tonerinkprint.com/hp_business_inkjet_3.

(Continued)

*Primary Examiner* — Julian Huffman
(74) *Attorney, Agent, or Firm* — HP Inc. Patent Department

(57) ABSTRACT

Examples include estimation of pen to paper spacing (PPS). Examples include an alignment pattern printed on a medium at a target speed, an optical scan procedure performed on the printed alignment pattern to determine values of cross-media misalignment for first and second portions of the alignment pattern, determination of a dynamic swath height error (DSHE) effect value based on the values of cross-media misalignment, and estimation of an amount of PPS based on the determined DSHE effect value and the target print speed.

15 Claims, 5 Drawing Sheets

(56) References Cited

U.S. PATENT DOCUMENTS

| | | | |
|---|---|---|---|
| 6,347,856 | B1 | 2/2002 | Arquilevich et al. |
| 6,361,137 | B1 | 3/2002 | Eaton et al. |
| 6,364,447 | B1 | 4/2002 | Boleda et al. |
| 6,394,568 | B1 | 5/2002 | Menendez |
| 6,669,325 | B2 | 12/2003 | Fredrickson et al. |
| 6,709,084 | B1 | 3/2004 | Nordlund et al. |
| 6,886,905 | B2 | 5/2005 | McElfresh et al. |
| 6,940,618 | B2 | 9/2005 | Kinas |
| 6,966,712 | B2 | 11/2005 | Trelewicz et al. |
| 6,981,756 | B2 | 1/2006 | Fredrickson et al. |
| 7,036,904 | B2 | 5/2006 | King et al. |
| 7,044,575 | B2 | 5/2006 | Kelley et al. |
| 7,156,482 | B2 | 1/2007 | Boleda et al. |
| 7,380,898 | B2 | 6/2008 | Plante et al. |
| 7,417,768 | B1 | 8/2008 | Donovan et al. |
| 7,588,302 | B2 | 9/2009 | Bastani et al. |
| 8,091,977 | B2 | 1/2012 | Masuyama |
| 8,100,494 | B2 | 1/2012 | Andrea et al. |
| 8,300,266 | B2 | 10/2012 | Yeh et al. |
| 2002/0063871 | A1 | 5/2002 | Kinas |
| 2003/0206209 | A1 | 11/2003 | Fredrickson et al. |
| 2005/0093900 | A1 | 5/2005 | King et al. |
| 2005/0146548 | A1 | 7/2005 | De Pena et al. |
| 2010/0309240 | A1 | 12/2010 | Tomida et al. |
| 2012/0212527 | A1 | 8/2012 | Sethne et al. |
| 2012/0212535 | A1 | 8/2012 | Sethne et al. |
| 2014/0022298 | A1* | 1/2014 | Li ..... B41J 29/393 347/19 |
| 2014/0055514 | A1 | 2/2014 | Hargis et al. |

OTHER PUBLICATIONS

Hewlett-Packard Company, "Service Manual," HP SCITEX LX600/LX800/LX820/LX850 and HP DESIGNEJET L65500, excerpts, Apr. 2011, pp. 1-2, 63-66, 276-278.

* cited by examiner

PPS ESTIMATION INFORMATION 262

| 264 PRINT SPEED (IPS) | 266 DSHE (DOTS @ 1200 DPI) | 268 PPS (MM) |
|---|---|---|
| 9 | 0.25 | 1.1 |
| 9 | 0.50 | 1.3 |
| 9 | 0.75 | 1.6 |
| 9 | 1.25 | 1.8 |
| 9 | 1.75 | 1.95 |
| 12 | 0.35 | 1.1 |
| 12 | 0.65 | 1.3 |
| 12 | 1.10 | 1.6 |
| 12 | 1.40 | 1.8 |
| 12 | 2.00 | 1.95 |
| 15 | 0.35 | 1.1 |
| 15 | 0.50 | 1.3 |
| 15 | 1.80 | 1.6 |
| 15 | 2.20 | 1.8 |
| 15 | 2.25 | 1.95 |

*FIG. 2D*

ESTIMATION OF PEN TO PAPER SPACING

BACKGROUND

A printing device, such as a printer, multifunction printer (MFP), or the like, may be utilized to print content on a physical medium such as paper. In some examples, the printing device may receive an electronic representation of the content from a computing device, such as a desktop or laptop computer, a mobile device, server, etc. In some examples, the computing device may include a print driver to render the content into a print-ready format that the printing device is able to print and to provide the rendered content to the printing device.

BRIEF DESCRIPTION OF THE DRAWINGS

The following detailed description references the drawings, wherein:

FIG. 2D is a diagram of an example table of PPS estimation information;

DETAILED DESCRIPTION

An inkjet printing device may print content on a medium by ejecting drops of ink from printhead nozzles. In such printing devices, a factor that has significant impact on print quality is pen to paper spacing (PPS), which is the spacing or distance between the printhead nozzles and the medium on which the nozzles are to print. As such, maintaining an appropriate PPS in an inkjet printing device may improve print quality. For example, adjusting PPS to within a desired range after transportation of the printing device may improve print quality. However, developing and producing PPS measurement tools that may be used to directly measure PPS for a printing device may involve very high costs.

To address these issues, in examples described herein, a printing device may estimate PPS based on an optical scanning procedure performed on an alignment pattern printed by the printing device. In this manner, the printing device may, for example, estimate PPS in the printing device via an automated process, without the use of a separate device to directly measure PPS, and without adding additional hardware to the printing device.

In examples described herein, a printing device may print first and second portions of an alignment pattern with adjacent printhead dice of a printbar on a medium in a single pass, in a single printing direction, and at a target speed. In such examples, the content of the second portion may induce greater cross-media misalignment when printed than the content of the first portion due to a dynamic swath height error (DSHE) effect. In such examples, the printing device may perform an optical scanning procedure on the printed alignment pattern to determine respective values of cross-media misalignment for the first and second portions of the printed alignment pattern, determine a DSHE effect value based on the determined values of cross-media misalignment, and estimate an amount of pen to paper spacing (PPS) at one of the adjacent dice based on the determined DSHE effect value and the target print speed.

Figure 1:
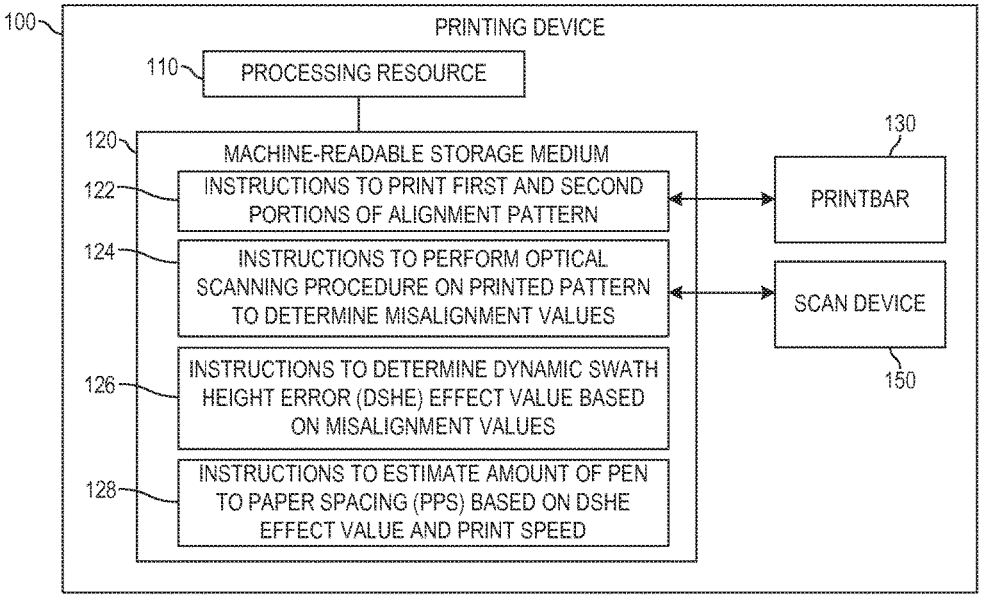
FIG. 1 is a block diagram of an example printing device to estimate an amount of pen to paper spacing (PPS) at a die of the printing device.

Referring now to the drawings, FIG. 1 is a block diagram of an example printing device 100 to estimate an amount of PPS (pen to paper spacing) at a die of the printing device 100. In examples described herein, a "printing device" may be a device to print content on a physical medium (e.g., paper or a layer of powder-based build material, etc.) with a printing fluid (e.g., ink) or toner. In the case of printing on a layer of powder-based build material, the printing device may utilize the deposition of printing fluids in a layer-wise additive manufacturing process. A printing device may utilize suitable printing consumables, such as ink, toner, fluids or powders, or other raw materials for printing. In some examples, a printing device may be a three dimensional (3D) printing device.

In some examples, a printing device may be an inkjet printing device to print content on a medium (e.g., paper) by ejecting drops of ink from printhead nozzles. In the example of FIG. 1, printing device 100 may be a page-wide array inkjet printing device comprising a printbar 130 including an array of printhead nozzles that together span a width of a page of media (e.g., paper) such that the printing device may print the content of a print job on the page in a single pass (e.g., of the media under the printbar) in a single printing direction (e.g., moving the page in one direction relative to the printbar while printing without any printing while moving the page in the opposite direction).

Figure 2A:
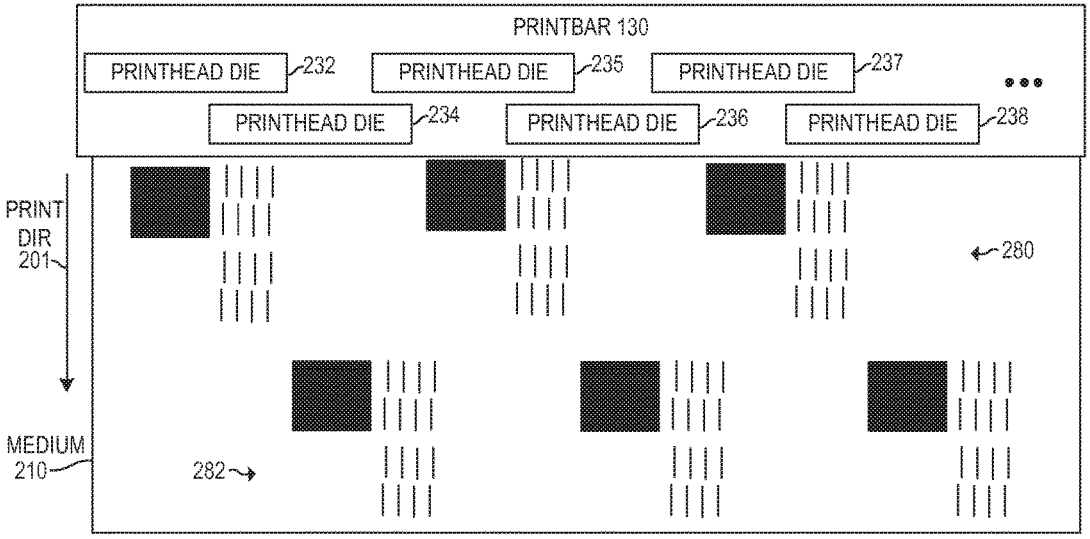
FIG. 2A is diagram illustrating a plurality of example alignment patterns printed by printhead dice of a printing device for determining PPS.

Referring to FIG. 2A, which shows a plan view of a portion of printbar 130 (i.e., from the top) and a portion of a medium 210, printbar 130 may include a plurality of printhead dice, including printhead dice 232 and 234-238. While six printhead dice are shown in FIG. 2A, printbar 130 may include more or fewer printhead dice. In some examples, printbar 130 may include 48 printhead dice. In some examples, each printhead die may include 1056 printhead nozzles to eject printing fluid (e.g., ink). In some examples, each printhead die may include multiple trenches of nozzles, each trench including nozzles to eject printing fluid of a different color. For example, printhead dice may include four trenches, each with nozzles to eject one of cyan (C), magenta (M), yellow (Y), and black (K). In some examples, printbar 130 may include a single printhead comprising all of the printhead dice of printbar 130. In other examples, printbar 130 may include a plurality of printheads, each comprising multiple (e.g., six) printhead dice of printbar 130. In some examples, printbar 130 may print content on medium 210 in a single pass as medium 210 is advanced in a single printing direction 201.

Figure 2B:
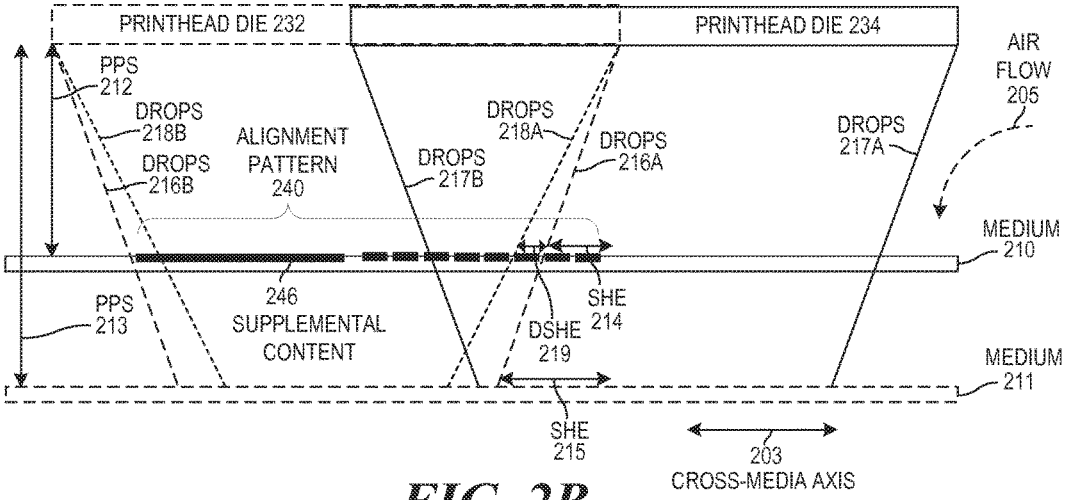
FIG. 2B is a diagram illustrating an example of a dynamic swath height error (DSHE) effect for a printing device.

As noted above, PPS (pen to paper spacing) may have a significant impact on print quality for an inkjet printing device, and examples described herein may estimate PPS for a printing device based at least in part on a DSHE (dynamic swath height error) effect value. FIG. 2B is a diagram illustrating an example of a dynamic swath height error (DSHE) effect for a printing device, and shows a cross-sectional view of a portion of printbar 130 (including dice 232 and 234) and a portion of a medium 210 along a cross-media axis 203 orthogonal to printing direction 201. In FIG. 2B, printhead die 234 is positioned partially in front of printhead die 232, which is indicated as further back via dotted lines.

In the example of FIG. 2B, as nozzles of printhead dice 232 and 234 eject drops of printing fluid (e.g., ink) down toward medium 210, air flow 205 directs the drops off of an expected trajectory straight down toward the medium and gives them a trajectory that is directed in towards the center of the printhead die the drops are ejected from. For example, air flow 205 directs drops 217A from die 234 inward toward the center of die 234, and similar air flow toward the center of die 234 on the other side directs drops 217B from die 234 in toward the center of die 234.

In such examples, similar air flow directs drops 216A from die 232 inward toward the center of die 232 and directs drops 216B from die 232 inward toward the center of die 232. For content printed by die 232, the illustrated alteration in drop trajectory for printhead die 232 due to air flow results in a swath height error (SHE) 214. As used herein, a "swath height error" is an amount of variation in the width of a content printed on a medium by a printhead die relative to what the width of the content would be were drops of printing fluid to fall straight down from the printhead die to the medium (e.g., at 90 degree angle relative to the surface of the medium). As used herein, a "swath" is content printed by a printhead (or printhead die) on a medium in a single pass.

As shown in FIG. 2B, air flow causes a SHE 214 for drops 216A of die 232 at PPS 212, reducing the width of a swath printed by printhead die 232 and altering an alignment of drops from die to the medium 210. As shown in FIG. 2B, greater PPS also causes greater SHE. For example, at a greater PPS 213 (e.g., between die 232 and another medium 211), printhead die 232 has a greater SHE 215.

The amount of swath height error (SHE) for a printhead die is also affected by the density of content printed by the printhead die, as increasing the number of simultaneous drops being fired by a printhead die increases the above-described air flow that results in SHE. This dynamic effect in which swath height error changes with the density of printed content is referred to herein as the "dynamic swath height error effect" (or "DSHE effect". In the example of FIG. 2B, drops 216A may fall with the trajectory illustrated in FIG. 2B when relatively low-density content is being printed by die 232, resulting in SHE 214. When relatively high-density supplemental content 246 is printed by die 232 (e.g., as part of an alignment pattern 240 described in more detail below), the DSHE effect may induce additional swath height error for drops ejected while printing the supplemental content 246, such as drops 218A and 218B for example, resulting in a greater swath height error equivalent to SHE 214 plus a DSHE effect value 219. In such examples, the DSHE effect value 219 may be the amount of swath height error caused by the additional printing of relatively high-density supplemental content 246, when SHE 214 is the amount of SHE experienced for die 232 when supplemental content 246 is not being printed by die 232. Although, for ease of illustration, air flow effects are shown in FIG. 2B for drops ejected at the edges of printhead dice, similar air flow effects may occur for drops ejected at other regions of printhead dice.

In examples described herein, the DSHE effect and DSHE effect values are along a cross-media axis 203 orthogonal to printing direction 201 in which medium 210 is advanced during printing in the example of FIGS. 2A-2D (illustrated in FIG. 2A, and directed out of the plane of FIG. 2B). In some examples, the amount of DSHE effect orthogonal to the printing direction experienced when printing content can be characterized for a given print speed, supplemental content density, and PPS (pen to paper spacing). In such examples, a printing device may determine a DSHE effect value for the printing device using predetermined supplemental content printed at a given print speed, and estimate a PPS value based on the determines DSHE effect value and print speed, as described below in relation to FIGS. 1-2D.

Referring to FIG. 1, printing device 100 includes a processing resource 110 and a machine-readable storage medium 120 comprising (e.g., encoded with) instructions 122, 124, 126, and 128 executable by processing resource 110 to cause printing device 100 perform the functionalities described below in relation to these instructions. In some examples, storage medium 120 may include additional instructions. In other examples, the functionalities described herein in relation to instructions 122, 124, 126, and 128, and any additional instructions described herein in relation to storage medium 120, may be implemented as engines comprising any combination of hardware and instructions (e.g., programming) to implement the functionalities of the engines, as described below. Printing device 100 also includes printbar 130, as described above, and a scan device 150.

Figure 2C:
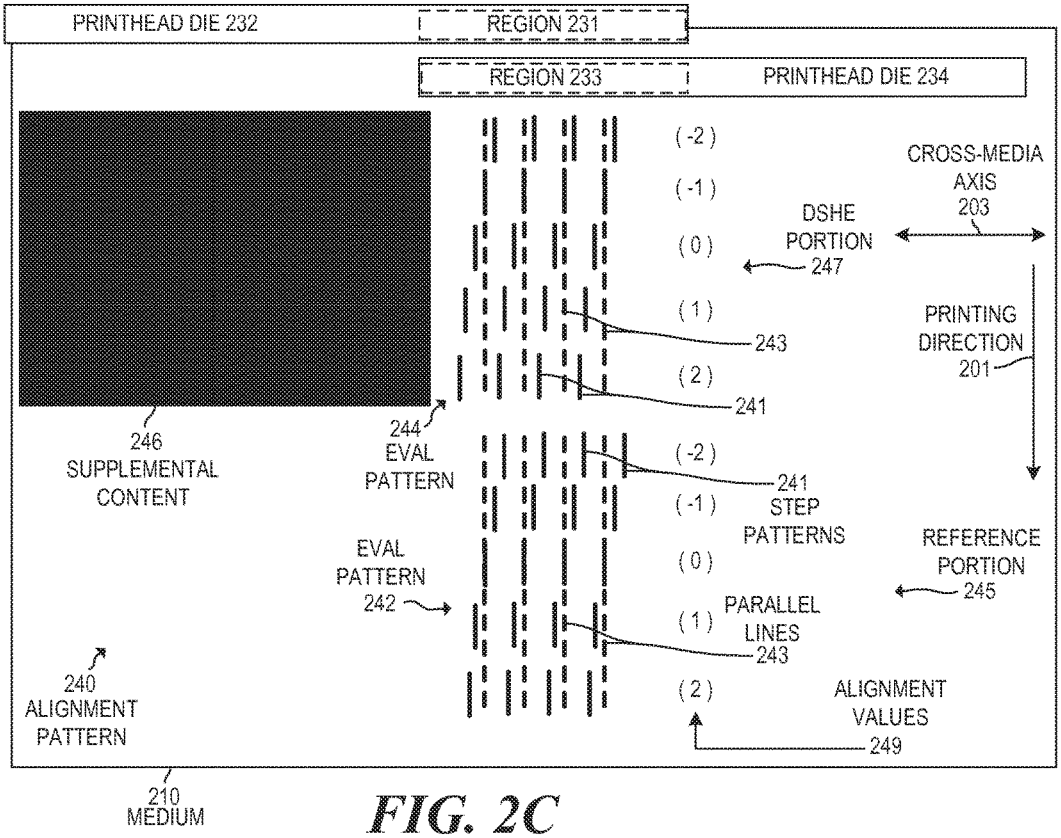
FIG. 2C is a diagram illustrating an example alignment pattern printed by adjacent printhead dice of a printing device for determining PPS.

For ease of understanding, examples of estimation of PPS will be described herein in relation to FIGS. 1-2D. FIG. 2C is a diagram illustrating an example alignment pattern 240 printed by adjacent printhead dice 232, 234 of printing device 100 for determining PPS. FIG. 2D is a diagram of an example table of PPS estimation information 262.

Referring to FIGS. 1 and 2C, instructions 122 may print an alignment patter 240, including a reference portion 245 and a DSHE portion 247, with adjacent printhead dice 232, 234 of a printbar 130 on a medium 210 in a single pass, in a single printing direction 201, and at a target speed. In such examples, the content of the DSHE portion 247 is to induce greater cross-media misalignment when printed than the content of reference portion 245 due to a DSHE effect. In examples described herein, "cross-media misalignment" may be misalignment of printed content along an axis orthogonal to the printing direction in which media advances while it is being printed on. In the example of FIGS. 2A-2C, cross-media misalignment is misalignment of printed content along cross-media axis 203 orthogonal to printing direction 201.

In the example of FIG. 2C, reference portion 245 of alignment pattern 240 includes a cross-media misalignment evaluation patter 242 indicating misalignment orthogonal to printing direction 201. DSHE portion 247 of alignment pattern 240 includes a cross-media misalignment evaluation patter 244 indicating misalignment orthogonal to printing direction 201, and includes supplemental content 246 separated from and adjacent to cross-media misalignment evaluation pattern 244. In the example of FIG. 2C, supplemental content 246 is excluded from reference portion 245.

In the example of FIG. 2C, supplemental content 246 of DSHE portion 247 may be a wide solid fill pattern excluded from reference portion 245. In such examples, the wide solid fill pattern 246 of DSHE 247 may induce greater cross-media misalignment in the printing of cross-media misalignment evaluation pattern 244 than in the printing of cross-media misalignment evaluation pattern 242 due to the DSHE effect described above. For example, as described above, printing additional relatively high-density supplemental content 246 in DSHE portion 247 will cause there to be a greater DSHE effect when printing DSHE portion 247 than when printing reference portion 245 without supplemental content 246. In examples described herein, this difference may be measured based on patterns 242 and 244, as described below.

In the example of FIG. 2C, due to the positioning of die 234 partially in front of die 232 in the printing direction 201, region 231 of die 232 and region 233 of die 234 are each able to print on the same portion of medium 210 and as such may be said to have "overlapping print coverage" herein. In examples described herein, printhead dice having regions with overlapping print coverage may be said to be "adjacent" printhead dice herein. In examples described herein, printing with a "region" of a printhead die includes printing with nozzle(s) in that region.

In the example of FIGS. 1 and 2C, instructions 122 may print portions of evaluation pattern 242 and portions of evaluation pattern 244 with printhead die 232, and may also print portions of evaluation pattern 242 and portions of evaluation pattern 244 with printhead die 243. For example, instructions 122 may print one portion (e.g., first marks) of evaluation pattern 242 with region 231 of die 232 and may print another portion (e.g., second marks) of evaluation pattern 242 with region 233 of die 234. Also, instructions 122 may print one portion (e.g., first marks) of evaluation pattern 244 with region 231 of die 232 and may print another portion (e.g., second marks) of evaluation pattern 244 with region 233 of die 234. In some examples, by printing evaluation patterns 242 and 244 partially with each of dice 232 and 234, cross-media misalignment between the content printed by each of dice 232 and 234 may be measured, as described below.

In the example of FIGS. 1 and 2C, each of evaluation patterns 242 and 244 may comprise a plurality of parallel lines 243 (e.g., parallel dotted lines) and a plurality of stepped line patterns 241. In some examples, instructions 122 may print the plurality of parallel lines 243 with region 233 of printhead die 234, for each of evaluation patterns 242 and 242. In some examples, these parallel lines 243 may serve as reference lines for determining cross-media misalignment of content printed by printhead die 232 with and without supplemental content 246. In such examples, instructions 122 may print the plurality of stepped line patterns 241 with region 231 of printhead die 232, for each of evaluation patterns 242 and 242.

In the example of FIGS. 1 and 2C, instructions 122 may print step patterns 241 of evaluation pattern 242 using die 232 (while not printing relatively high-density supplemental content 246), and may print step patterns 241 of evaluation pattern 244 using die 232 while also printing relatively high-density supplemental content 246. In such examples, the alignment of step patterns 241 with parallel lines 243 may differ between reference portion 245 and DSHE portion 247 due to the DSHE effect when printing the DSHE portion 247 including supplemental content 246. For example, as described above in relation to FIG. 2B, printing supplemental content 246 will cause additional SHE (swath height error) due to the DSHE (dynamic swath height error) effect, such that drops ejected may be pushed more toward the center of printhead die 232 than when supplemental content 246 is not printed (i.e., pushed more toward the region of the media directly under the center of printhead die 232). As such, due to the DSHE effect when printing supplemental content 246 in the example of FIG. 2C, the step patterns 241 printed by region 231 of die 232 while also printing supplemental content 246 with die 232 (i.e., step patterns of DSHE portion 247) will be more misaligned with parallel lines 243 than the step patterns 241 printed by region 231 of die 232 while not printing supplemental content 246 (i.e., step patterns of reference portion 245).

In such examples, because the difference in the misalignment between the line and step patterns for evaluation patter 242 of reference portion 245 and evaluation pattern 244 of DSHE portion 247 is due to the DSHE effect, determining the difference in the misalignment between patterns 242 and 244 may yield an estimate of the DSHE effect for the printing of these patterns.

In the example of FIGS. 1 and 2C, after instructions 122 print alignment pattern 240, including reference portion 245 and DSHE portion 247, instructions 124 may perform an optical scanning procedure on the printed alignment pattern to determine respective values of cross-media misalignment for reference portion 245 and for DSHE portion 247 of the printed alignment pattern 240.

In some examples, after instructions 122 print reference portion 245 and DSHE portion 247 of alignment patter 240, instructions 124 may pull medium 210 in a direction opposite the single printing direction 201 (i.e., backwards) with printing device 100 and optically scan each of cross-media misalignment evaluation patterns 242 and 244. Instructions 124 may further determine the respective values of cross-media misalignment for reference portion 245 and DSHE portion 247 of printed alignment pattern 240 based on the optical scanning of patterns 242 and 244.

In some examples, instructions 124 may utilize scan device 150 to scan medium 210 along the cross-media axis 203 while pulling medium in the direction opposite printing direction 201 with printing device 100. For example, instructions 124 may sequentially pull medium 210 backwards and scan evaluation pattern 244 once for each horizontal band defined by the steps of the step patterns 241 of evaluation pattern 244, to determine the step at which step patterns 241 overlap with parallel lines 243. For ease of understanding, respective alignment values 249 ranging between (2) and (−2) are illustrated next to each of the horizontal bands of evaluation pattern 244. Scan device 150 may include a densitometer and may identify the horizontal band having the least optical density as the horizontal band where the line and step patterns overlap. In the example of FIGS. 1 and 2C, instructions 124 may determine that the second horizontal band scanned with device 150 in pattern 244 (e.g., the band adjacent to alignment value −1) has the least optical density, and as such is where the line and step patterns overlap. Instructions 124 may determine the cross-media misalignment value for evaluation patter 244 based on which horizontal band in evaluation pattern 244 has the overlap. For example, predetermined values of cross-media misalignment error may be predetermined for each horizontal band. As an example, in FIG. 2C, the illustrated alignment values may each correspond to a number of dots of cross-media misalignment at 1200 dots per inch (dpi) for the corresponding horizontal band, where the sign of the values (e.g., + or −) indicates the direction of the misalignment. In the example of FIG. 2C, overlap in the band illustrated as adjacent to alignment value (−1) in FIG. 2C may indicate a cross-media misalignment value of (−1) dot at 1200 dpi. In other examples, other predetermined values may be used.

In such examples, instructions 124 may scan evaluation patter 242 with scan device 150, in the same manner as described above in relation to patter 244, to determine the cross-media misalignment value for evaluation pattern 242. In the example of FIGS. 1 and 2C, instructions 124 may determine that the third horizontal band scanned for pattern 242 has the least optical density (e.g., adjacent to alignment value 0), and as such is where the line and step patterns overlap, and may determine the cross-media misalignment value based on overlap in that band. For example, overlap in the third band of patten 242 (illustrated as adjacent to value (0) in FIG. 2C) may indicate a cross-media misalignment value of 0.

Although alignment values 249 are included in FIG. 2C for illustrative purposes, alignment pattern 240 may be printed without those values. In such examples, instructions 124 may determine the appropriate cross-media misalignment value based on which horizontal band, scanned in sequence, was determined to have the overlap (e.g., for pattern 244 of FIG. 2C, the value is determined based on the overlap being in the second horizontal band scanned). Although five horizontal bands are included in each of evaluation patterns 242 and 244, these patterns may each contain more or fewer bands. For example, patterns 242 and 244 may include 11 horizontal bands, including step patterns 241 having 11 steps each.

In the example of FIG. 1, instructions 126 may determine a DSHE effect value based on the determined values of cross-media misalignment for the reference portion 245 and the DSHE portion 247. For example, instructions 126 may determine the DSHE effect value based on a difference between the determined values of cross-media misalignment. For example, the DSHE effect value may equal the cross-media misalignment value for the reference portion 245 minus the cross-media misalignment value for the DSHE portion 247 (i.e., DSHE value=misalignment without supplemental content−misalignment with supplemental content). In the example described above in relation to FIG. 2C, the DSHE effect value may be 1 dot at 1200 dpi, found by instructions 126 by taking the cross-media misalignment value for the reference portion 245 (i.e., 0) minus the cross-media misalignment value for the DSHE portion 247 (i.e., −1). In such examples, instructions 126 determine that the DSHE effect value=0−(−1)=1 dot at 1200 dpi. In other examples, different values may be found. For example, when a misalignment value of 1 is determined for reference portion 245 and a misalignment value of −3 is determined for DSHE portion 247, then instructions 126 may determine that the DSHE effect value is 2 dot at 1200 dpi (i.e., 1−(−3)=2).

In the example of FIG. 1, instructions 128 may estimate an amount of PPS (pen to paper spacing) at printhead die 232 based on the determined DSHE effect value and the target print speed at which alignment pattern 240 was printed. For example, instructions 128 may estimate the amount of PPS at printhead die 232 based on PPS estimation information 262 defining relationships between DSHE effect values, print speeds, and PPS values. In some examples, such PPS estimation information 262 may be obtained by performing tests to observe DSHE effect values resulting from printing content of known density (e.g., supplemental content 246) at different PPS values and different print speeds. In this manner. PPS estimation information may be determined, with which instructions 128 may estimate PPS based on a given print speed and a DSHE effect value determined as described above.

FIG. 2D is a diagram of an example table of PPS estimation information 262. PPS estimation information 262 may include PPS values corresponding to respective pairs of print speed values and DSHE effect values. Based on PPS estimation information 262, instructions 128 may determine PPS values based on print speeds and determined DSHE effect values. For example, in an example in which 2 was the determined DSHE effect value and 12 inches per second (ips) was the target print speed at which alignment pattern 240 was printed, instructions 128 may estimate the PPS value for one of the dice to be 1.95 mm.

In examples described herein, there are several different manners in which PPS estimation information 262 may be utilized to estimate PPS values. For example, discrete PPS values may correspond to discrete pairs of print speed values and DSHE effect values. In such examples, instructions 128 may select an appropriate PPS value based on the corresponding print speed and DSHE effect value. In some examples, when a determined DSHE effect value does not correspond precisely to one in the table, instructions 128 may interpolate an appropriate PPS value for the a determined DSHE effect value based on the nearest DSHE values higher and lower than the determined DSHE effect value, and their respective PPS values in PP estimation information 262.

In other examples, PPS values may correspond to discrete print speed values and DSHE effect value ranges. In such examples, instructions 128 may select the PPS value that corresponds to the appropriate print speed and the DSHE effect value range that includes the determined DSHE effect value. In other examples, instructions 128 may use any other suitable technique to estimate a PPS value based on the speed, determined DSHE effect value, and PPS estimation information. In the example of FIG. 2D, print speed is expressed in ips, DSHE effect values are expressed in dots at 1200 dpi, and PPS is expressed in mm. In other examples, other suitable units may be used.

In some examples, one collection of PPS estimation information 262 may be obtained and utilized by instructions 128 for estimating PPS values, regardless of the colors used to print alignment pattern 240. In other examples, a different collection of PPS estimation information may be obtained and utilized for each different color of a printhead die (e.g., C, M, Y, and K).

In the example of FIG. 2C, supplemental content may be a wide solid fill pattern, as illustrated in FIG. 2C. In examples described herein, a "wide solid fill pattern" may be a pattern including a solid block of at least one color separated from and adjacent to a cross-media misalignment evaluation pattern and significantly wider than the cross-media misalignment evaluation pattern orthogonal to the printing direction 201. For example, a wide solid fill patter may be approximately 10-20 times wider than the adjacent a cross-media misalignment evaluation patter. In some examples, the wide solid fill patter may be printed utilizing substantially all of the nozzles of a given color on a printhead die except for the nozzles in a region being utilized to print at least portions of the cross-media misalignment evaluation pattern and the nozzles in a small region defining a separation between the evaluation pattern and the solid fill pattern. For example, referring to FIG. 2C, of the 1056 nozzles of a given color of printhead die 232, region 231 may include 48 nozzles for the printing of the evaluation patterns 242 and 244, 12 nozzles may be unused to provide the separation, and the remaining 996 nozzles of printhead die 232 may be utilized to print the wide solid fill area 246.

Although media is moved relative to a printbar in examples described herein, in other examples, the printbar may be moved relative to the media such that printing occurs in only a single printing direction. As used herein, a "processor" may be at least one of a central processing unit (CPU), a semiconductor-based microprocessor, a graphics processing unit (GPU), a field-programmable gate array (FPGA) configured to retrieve and execute instructions, other electronic circuitry suitable for the retrieval and execution instructions stored on a machine-readable storage medium, or a combination thereof. Processing resource 110 may fetch, decode, and execute instructions stored on storage medium 120 to perform the functionalities described above. In other examples, the functionalities of any of the instructions of storage medium 120 may be implemented in the form of electronic circuitry, in the form of executable instructions encoded on a machine-readable storage medium, or a combination thereof.

As used herein, a "machine-readable storage medium" may be any electronic, magnetic, optical, or other physical storage apparatus to contain or store information such as executable instructions, data, and the like. For example, any machine-readable storage medium described herein may be any of Random Access Memory (RAM), volatile memory, non-volatile memory, flash memory, a storage drive (e.g., a hard drive), a solid state drive, any type of storage disc (e.g., a compact disc, a DVD, etc.), and the like, or a combination thereof. Further, any machine-readable storage medium described herein may be non-transitory. In examples described herein, a machine-readable storage medium or media is part of an article (or article of manufacture). An article or article of manufacture may refer to any manufactured single component or multiple components. The storage medium may be located either in the computing device executing the machine-readable instructions, or remote from but accessible to the computing device (e.g., via a computer network) for execution.

In some examples, instructions 122, 124, 126, and 128 may be part of an installation package that, when installed, may be executed by processing resource 110 to implement the functionalities described herein in relation to instructions 121. In such examples, storage medium 120 may be a portable medium, such as a CD. DVD, or flash drive, or a memory maintained by a server from which the installation package can be downloaded and installed. In other examples, instructions 122, 124, 126, and 128 may be part of an application, applications, or component(s) already installed on a computing device 100 including processing resource 110. In some examples, functionalities described herein in relation to FIGS. 1-2D may be provided in combination with functionalities described herein in relation to any of FIGS. 3-5.

Figure 3:
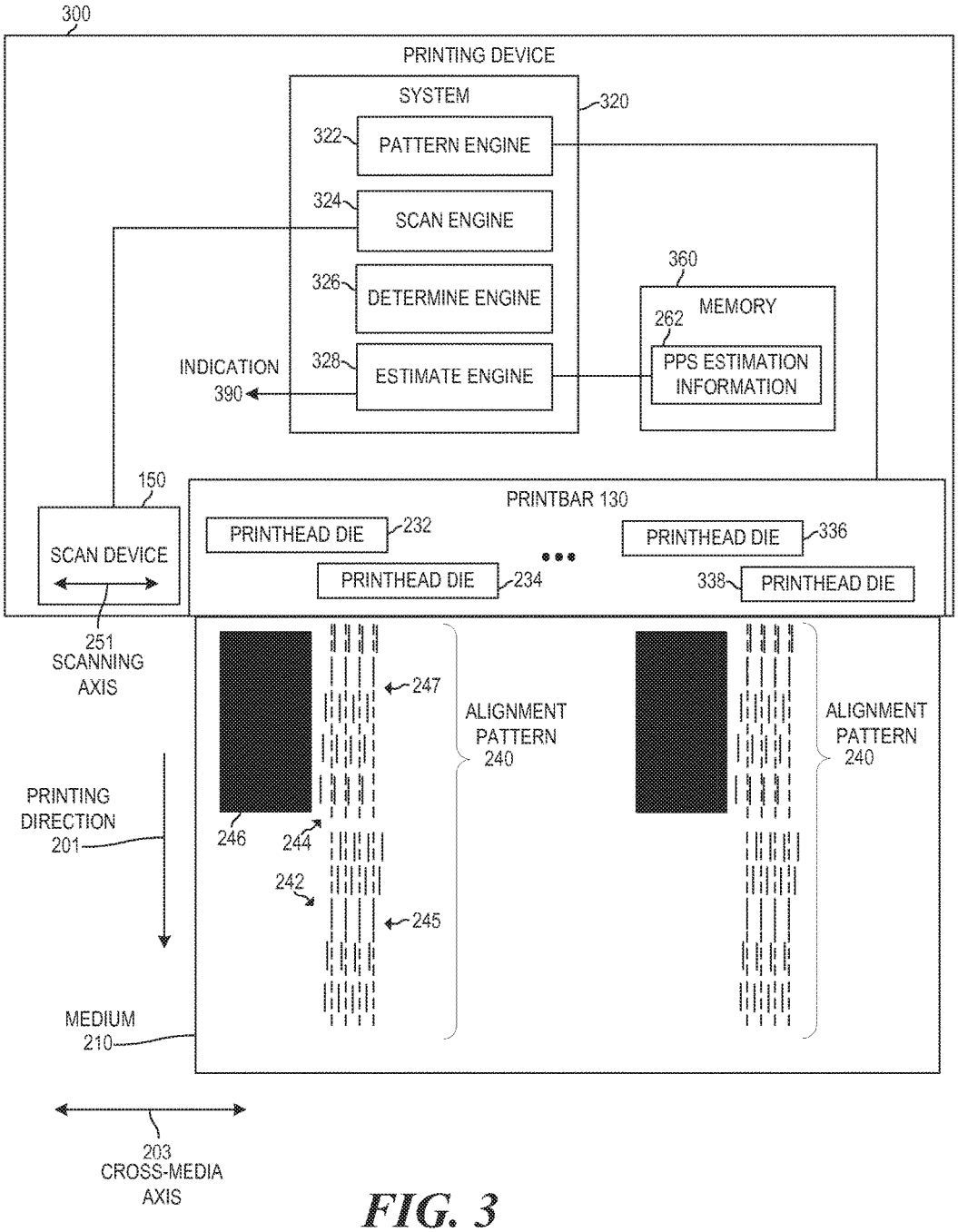
FIG. 3 is a block diagram of an example printing device including an example system to print an alignment pattern and estimate an amount of PPS for the printing device.

FIG. 3 is a block diagram of an example printing device 300 including an example system 320 to print an alignment pattern 240 and estimate an amount of PPS for at least a portion of printing device 300. In the example of FIG. 3, printing device 300 may be a page-wide array inkjet printing device comprising a printbar 130 including an array of printhead nozzles that together span a width of a page of media, as described above in relation to printing device 100 of FIG. 1. Printing device 300 includes a printbar 130, as described above in relation to FIGS. 1-2C, a scan device 150 as described above, memory 360, and a system 320 including engines to perform the functionalities described below. For ease of understanding, examples of estimation of PPS will be described herein in relation to FIG. 3 and FIGS. 2A-2D, described above.

In the example of FIG. 3, a printbar comprises a plurality of printhead dice to print content on a medium in a single pass and in a single printing direction 201. Although four printhead dice 232, 234, 336, and 338 are illustrated in FIG. 3, printbar 130 may comprise additional printhead dice, as described above. Pattern engine 322 of system 320 may cause printbar 130 to print reference and DSHE portions 245 and 247 of an alignment pattern 240 on medium 210 with adjacent printhead dice 232, 234 of printbar 130 in a single pass and printing direction and at a target speed, as described above in relation to FIGS. 1-2C. Supplemental content 246 included in DSHE portion 247 may induce greater cross-media misalignment orthogonal to printing direction 201 in the printing of DSHE portion 247 than in the printing of the reference portion 245 excluding supplemental content 246, due to the DSHE (dynamic swath height error) effect, as described above in relation to FIGS. 1-2C. The DSHE effect is orthogonal to printing direction 201.

In the example of FIG. 3, pattern engine 322 is to print a cross-media misalignment evaluation pattern 242 of the reference portion 245 partially with printhead die 232 and partially with printhead die 234, as described above. Patter engine 322 is further to print a cross-media misalignment evaluation pattern 244 of DSHE portion 247 partially with printhead die 232 and partially with printhead die 234. Pattern engine 320 is further to print a wide solid fill pattern 246 parallel with evaluation pattern 244, with the printhead die 232 as the supplemental content 246 of DSHE portion 247. The wide solid fill pattern 246 may be separated from and adjacent to other marks of DSHE portion 247 of alignment pattern 240, such as evaluation pattern 244.

In the example of FIG. 3, scan engine 324 of system 320 may, with scan device 150 as described above, perform an optical scanning procedure on the printed alignment pattern 240 to determine respective values for cross-media misalignment orthogonal to the printing direction for the reference and DSHE portions 245 and 247 of the printed alignment pattern 240, as described above in relation to FIGS. 1-2C.

Engine 324 may pull medium 210 in a direction opposite the single printing direction 201 (i.e., backwards) with printing device 300 and optically scan each horizontal band of each of cross-media misalignment evaluation patterns 242 and 244 with scan device 150, as described above in relation to instructions 124. Scan engine 324 may further determine the respective values of cross-media misalignment for reference portion 245 and DSHE portion 247 of printed alignment pattern 240 based on the optical scanning of patterns 242 and 244, as described above in relation to instructions 124. In the example of FIG. 3, scan device 150 may be operable to move along a scanning axis 251 orthogonal to the printing direction 201 to scan each horizontal band of alignment pattern 240.

Engine 326 of system 320 may determine a DSHE effect value based on the determined cross-media misalignment values, as described above in relation to instructions 126. For example, engine 326 may determine the DSHE effect value based on the difference between the determined cross-media misalignment values, as described above.

Estimate engine 328 may estimate an amount of PPS (pen to paper spacing) at printhead die 232 based on the determined DSHE effect value and the target print speed, in any manner as described above in relation to instructions 128 and PPS estimation information 262 stored in memory 360. For example, engine 328 may estimate the amount of PPS at printhead die 232 based on PPS estimation information 262 (see FIG. 2D) defining relationships between given DSHE effect values and print speeds, and respective PPS values, in any suitable manner as described above in relation to instructions 128. For example, the relationships may include relationships between print speeds, DSHE effect value ranges, and respective PPS values. In examples described herein, memory 360 may be at least one machine-readable storage medium of printing device 300.

In some examples, pattern engine 322 may print a respective instance of alignment patter 240 with each of a plurality of pairs of adjacent printhead dice of printbar 130. For example, in the example of FIG. 3, the pair of adjacent printhead dice 232 and 234 may print alignment pattern 240 on medium 210 as described above, and similarly, another pair of adjacent printhead dice 336 and 338 may print another instance of the same alignment pattern 240 on medium, as shown in FIG. 3. In such examples, thought instances of the same alignment pattern 240 are printed, the printed results may vary (e.g., display different cross-media misalignment) due to different characteristics at different printhead dice (e.g., different PPS).

In such examples, scan engine 324, using scan device 150, may scan each of the evaluation patterns of the alignment patterns 240, as described above, to determine cross-media misalignment values for each evaluation pattern of each alignment pattern 240. In such examples, for each pair of printhead dice that printed an alignment pattern 240, engine 326 may determine a DSHE effect value based on the misalignment values determined from the printed alignment pattern, as described above. In such examples, estimate engine 328 may, for each of the pairs of adjacent printhead dice that printed an alignment pattern 240, estimate an amount of PPS at one of the adjacent printhead dice based on the target print speed at which patterns 240 were printed and an DSHE effect value determined based on the respective alignment pattern 240 printed with the pair of adjacent printhead dice.

For example, estimate engine 328 may estimate an amount of PPS at printhead die 232 based on the target print speed and the DSHE effect value determined based on alignment pattern 240 printed with printhead dice 232 and 234, and may estimate an amount of PPS at printhead die 336 based on the target print speed and the DSHE effect value determined based on alignment pattern 240 printed with printhead dice 336 and 338, as described above.

Engine 328 may further derive a PPS evaluation value based on at least one of the estimated amounts of PPS and determine whether the PPS evaluation value is within a target PPS range. For example, engine 328 may derive the PPS evaluation value by combining at least one (or each) of the estimated amounts of PPS determined for the respective pairs of printhead dice. In some examples, engine 328 may determine a mean of estimated amounts of PPS as the PPs evaluation value. In other examples, the estimated amounts of PPS may be combined in any other suitable manner to derive the PPS evaluation value.

After deriving the PPS evaluation value, engine 328 may determine whether the PPS evaluation value is within a target PPS range indicating a target range for PPS for quality operation printing device 300. In some examples, the target PPS range may be stored on printing device 300 (e.g., in memory 360).

In response to a determination that the PPS evaluation value is outside of the target PPS range, engine 328 may determine to output an indication 390 that PPS of printing device 300 PPS is to be adjusted. In such examples, engine 328 may output the indication 390 in any suitable manner in response to the determination, such as via a display of printing device 300, etc. In response to a determination that the PPS evaluation value is within the target PPS range, engine 328 may determine to output an indication that the printing device has a suitable PPS, and may output the indication in any suitable manner in response to the determination.

Although two instances of alignment pattern 240, printed with two different pairs of adjacent printhead dice are illustrated in FIG. 3, in other examples, more instances of alignment pattern 240 may be printed with more pairs of adjacent printhead dice. In such examples, for each pair of printhead dice that prints an alignment pattern 240, an amount of PPS may be estimated for one of the pair of printhead dice. In such examples, multiple of each of the estimated amounts of PPS may be used to derive the PPS evaluation value described above.

For example, referring again to FIG. 2A, a first set 280 of alignment patterns 240 may be printed by each pair of adjacent printhead dice, including adjacent dice 232, 234, adjacent dice 235, 236, and adjacent dice 237, 238. The first set of alignment patterns may be scanned as described above to estimate an amount of PPS for each of printhead dice 232, 235, and 237. To estimate amounts of PPS for the other printhead dice, second set 282 of alignment patterns 240 may be printed by different pairs of adjacent printhead dice, including adjacent dice 234, 235, adjacent dice 236, 237, and adjacent dice 238 and an adjacent die. The second set of alignment patterns may be scanned as described above to estimate an amount of PPS for each of printhead dice 234, 236, and 238.

In some examples, pattern engine 322 may determine how many instances of alignment pattern 240 to print with adjacent printhead dice to be scanned for estimating PPS based on a size of media loaded into printer 300. For example, when the loaded media is of a smaller size having width covered by fewer than all of the printhead dice, then instances of alignment pattern 240 may be printed by pairs of adjacent dice that are useable to print on that size media.

In the example of FIG. 3, system 320 may be implemented by at least one computing device and may include at least engines 322, 324, 326, and 328, which may be any combination of hardware and machine-readable instructions (e.g., programming) to implement the functionalities of the engines described herein. In examples described herein, such combinations of hardware and instructions may be implemented in a number of different ways. For example, the instructions for the engines may be processor executable instructions stored on at least one non-transitory machine-readable storage medium and the hardware for the engines may include at least one processing resource to execute those instructions. In such examples, the at least one machine-readable storage medium may store instructions that, when executed by the at least one processing resource, implement the engines of system 320. In such examples, system 320 may include the at least one machine-readable storage medium storing the instructions and the at least one processing resource to execute the instructions, or one or more of the at least one machine-readable storage medium may be separate from but accessible to system 320 and the at least one processing resource (e.g., via a computer network).

In some examples, the instructions can be part of an installation package that, when installed, can be executed by the at least one processing resource to implement at least the engines of system 320. In such examples, the machine-readable storage medium may be a portable medium, such as a CD, DVD, or flash drive, or a memory maintained by a server from which the installation package can be downloaded and installed. In other examples, the instructions may be part of an application, applications, or component already installed on system 320 including the processing resource. In such examples, the machine-readable storage medium may include memory such as a hard drive, solid state drive, or the like. In other examples, the functionalities of any engines of system 320 may be implemented in the form of electronic circuitry. In some examples, functionalities described herein in relation to FIG. 3 may be provided in combination with functionalities described herein in relation to any of FIGS. 1-2D and 4-5.

Figure 4:
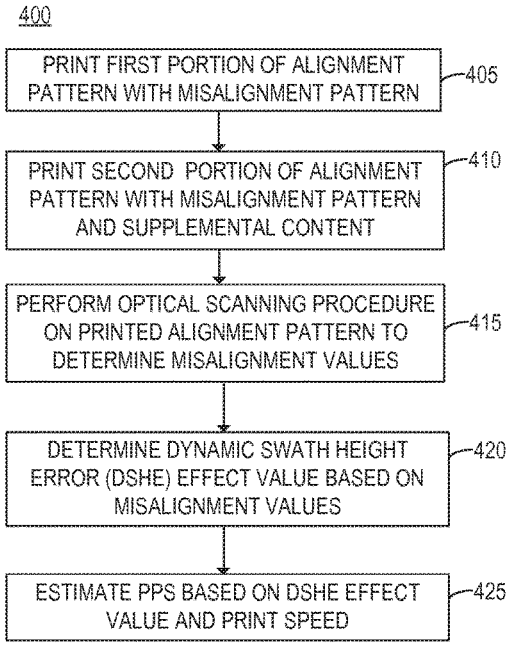
FIG. 4 is a flowchart of an example method for estimating an amount of PPS for a printing device.

FIG. 4 is a flowchart of an example method 400 for estimating an amount of PPS for a printing device. Although execution of method 400 is described below with reference to printing device 300 of FIG. 3, other suitable computing devices for the execution of method 400 can be utilized (e.g., printing device 100 of FIG. 1). Additionally, implementation of method 400 is not limited to such examples. For ease of explanation, method 400 will also be explained in relation to the example of FIG. 2C.

At 405 of method 400, engine 322 may print, on a medium 210 with printbar 130, a reference portion 245 of an alignment pattern 240, the reference portion 245 including a cross-media misalignment evaluation pattern 242. Reference portion 245 of alignment patter 240 is printed with adjacent printhead dice 232, 234 of a printbar 130 of printing device 300 in a single pass along the medium 210, in a single printing direction 201, and at a target speed.

At 410, engine 322 may print, on medium 210 with printbar 130, a DSHE portion 247 of alignment patter 240, the DSHE portion 247 including a cross-media misalignment evaluation pattern 244, and supplemental content 246 not included in the reference portion 245. In such examples, supplemental content 246 may induce greater cross-media misalignment when printed than the content of the reference portion 245 due to a DSHE (dynamic swath height error) effect, as described above. DSHE portion 247 of alignment pattern 240 is printed with the adjacent printhead dice 232, 234 of printbar 130, used to print reference portion 245, in a single pass along the medium 210, in a single printing direction 201, and at the target speed.

At 415, engine 324 may, with scan device 150, perform an optical scanning procedure on the printed alignment pattern 240 to determine respective values of cross-media misalignment, orthogonal to the single printing direction 201, for each of the reference and DSHE portions 245 and 247 of printed alignment pattern 240, as described above.

At 420, engine 326 may determine a DSHE effect value based on the determined cross-media misalignment values. For example, engine 326 may determine the DSHE effect value based on the difference between the determined cross-media misalignment values. At 425, engine 328 may estimate an amount of PPS (pen to paper spacing) at printhead die 232 of the adjacent printhead dice 232, 234, based on the determined DSHE effect value and the target print speed, as described above. For example, the amount of PPS may be estimated based on the determined DSHE effect value and PPS estimation information 262.

Although the flowchart of FIG. 4 shows a specific order of performance of certain functionalities, method 400 is not limited to that order. For example, the functionalities shown in succession in the flowchart may be performed in a different order, may be executed concurrently or with partial concurrence, or a combination thereof. In some examples, functionalities described herein in relation to FIG. 4 may be provided in combination with functionalities described herein in relation to any of FIGS. 1-3 and 5.

Figure 5:
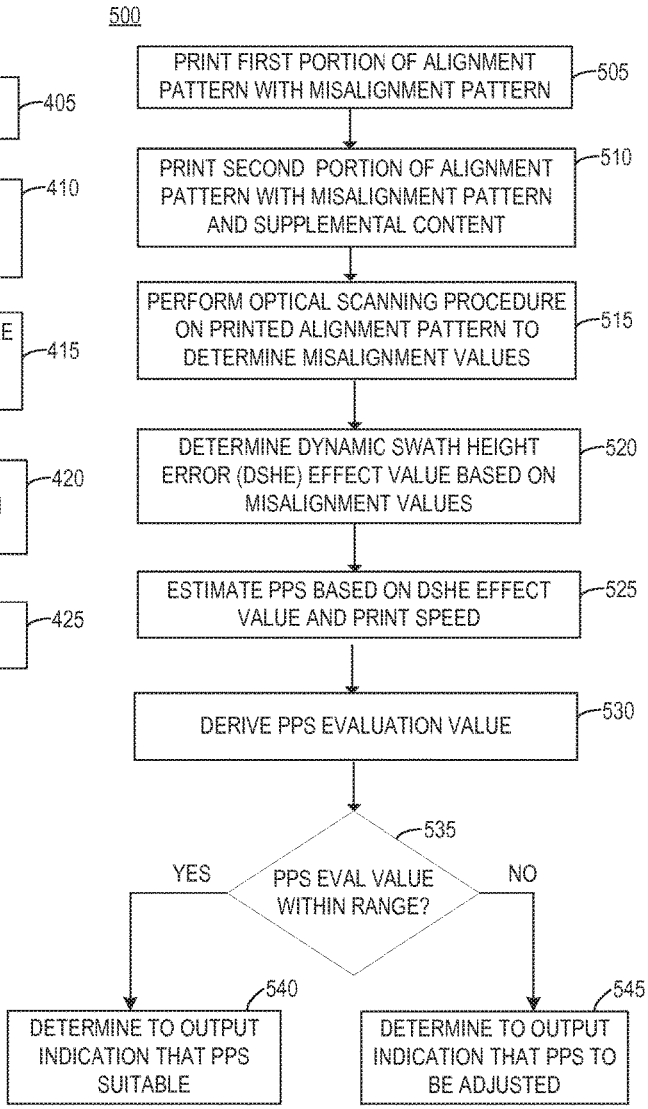
FIG. 5 is a flowchart of an example method for deriving a PPS evaluation value for a printing device.

FIG. 5 is a flowchart of an example method 500 for deriving a PPS evaluation value for a printing device. Although execution of method 500 is described below with reference to printing device 300 of FIG. 3, other suitable computing devices for the execution of method 500 can be utilized (e.g., printing device 100 of FIG. 1). Additionally, implementation of method 500 is not limited to such examples. For ease of explanation, method 500 will also be explained in relation to the example of FIG. 2C.

At 505 of method 500, engine 322 may print, on a medium 210 with printbar 130, a reference portion 245 of an alignment pattern 240, the reference portion 245 including a cross-media misalignment evaluation pattern 242. Reference portion 245 of alignment pattern 240 is printed with adjacent printhead dice 232, 234 of a printbar 130 of printing device 300 in a single pass along the medium 210, in a single printing direction 201, and at a target speed.

At 510, engine 322 may print, on medium 210 with printbar 130, a DSHE portion 247 of alignment pattern 240, the DSHE portion 247 including a cross-media misalignment evaluation pattern 244, and supplemental content 246 not included in the reference portion 245. In such examples, supplemental content 246 may induce greater cross-media misalignment when printed than the content of the reference portion 245 due to a DSHE (dynamic swath height error) effect, as described above. DSHE portion 247 of alignment pattern 240 is printed with the adjacent printhead dice 232, 234 of printbar 130, used to print reference portion 245, in a single pass along the medium 210, in a single printing direction 201, and at the target speed.

At 515, engine 324 may, with scan device 150, perform an optical scanning procedure on the printed alignment pattern 240 to determine respective values of cross-media misalignment, orthogonal to the single printing direction 201, for each of the reference and DSHE portions 245 and 247 of printed alignment pattern 240, as described above.

At 520, engine 326 may determine a DSHE effect value based on the determined cross-media misalignment values. For example, engine 326 may determine the DSHE effect value based on the difference between the determined cross-media misalignment values. At 525, engine 328 may estimate an amount of PPS (pen to paper spacing) at printhead die 232 of the adjacent printhead dice 232, 234, based on the determined DSHE effect value and the target print speed, as described above. For example, the amount of PPS may be estimated based on the determined DSHE effect value and PPS estimation information 262.

At 530, engine 328 may derive a PPS evaluation value based on at least the estimated amount of PPS, as described above. At 535, engine 328 may determine whether the PPS evaluation value is within a target PPS range, which may be a desired range for PPS for quality operation of printing device 300. In such examples engine 328 may determine to output either a first indication that the printing device has a suitable PPS or a second indication that the printing device PPS is to be adjusted, based on whether the PPS evaluation value is determined to be within the target PPS range.

For example, in response to a determination that the PPS evaluation value is within the target range, then at 540, engine 328 may determine to output a first indication that printing device 30 has a suitable PPS, and may output the first indication in any suitable manner. In response to a determination that the PPS evaluation value is outside of the target range, then at 545, engine 328 may determine to output a second indication that the printing device PPS is to be adjusted, and may output the second indication in any suitable manner.

Although the flowchart of FIG. 5 shows a specific order of performance of certain functionalities, method 500 is not limited to that order. For example, the functionalities shown in succession in the flowchart may be performed in a different order, may be executed concurrently or with partial concurrence, or a combination thereof. In some examples, functionalities described herein in relation to FIG. 5 may be provided in combination with functionalities described herein in relation to any of FIGS. 1-4.

All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A non-transitory machine-readable storage medium comprising instructions executable by a processing resource of a printing device to cause the printing device to:

print first and second portions of an alignment pattern with adjacent printhead dice of a printbar on a medium in a single pass, in a single printing direction, and at a target speed, wherein content of the second portion is to induce greater cross-media misalignment when printed than content of the first portion due to a dynamic swath height error (DSHE) effect;

perform an optical scanning procedure on the printed alignment pattern to determine respective values of cross-media misalignment for the first and second portions of the printed alignment pattern;

determine a DSHE effect value based on the determined values of cross-media misalignment; and based on the determined DSHE effect value and the target print speed, estimate an amount of pen to paper spacing (PPS) at one of the adjacent dice.

2. The storage medium of claim 1, wherein the instructions to estimate comprise instructions to:

estimate the amount of PPS at the one of the adjacent printhead dice based on PPS estimation information defining relationships between DSHE effect values, print speeds, and PPS values.

3. The storage medium of claim 1, wherein the determined values of cross-media misalignment represent misalignment of printed content along an axis orthogonal to the single printing direction.

4. The storage medium of claim 3, wherein:

the first portion of the alignment patter includes a first cross-media misalignment evaluation patter indicating misalignment orthogonal to the single printing direction;

the second portion of the alignment patter includes a second cross-media misalignment evaluation pattern indicating misalignment orthogonal to the single printing direction, and includes a wide solid fill pattern separated from and adjacent to the second cross-media misalignment evaluation pattern;

the first portion excludes any wide solid fill pattern; and the wide solid fill pattern is to induce greater cross-media misalignment in the printing of the second cross-media misalignment evaluation pattern than in the printing of the first cross-media misalignment evaluation pattern due to the DSHE effect.

5. The storage medium of claim 4, wherein the instructions to print comprise instructions to:

print first marks of each of the first and second cross-media misalignment evaluation patterns with a first printhead die of the adjacent printhead dice;

print second marks of each of the first and second cross-media misalignment evaluation patterns with a second printhead die of the adjacent printhead dice; and print the wide solid fill pattern with the first printhead die.

6. The storage medium of claim 5, wherein:

for each of the first and second cross-media misalignment evaluation patterns, the first marks of the cross-media misalignment evaluation patterns comprise a plurality of stepped line patterns;

for each of the first and second cross-media misalignment evaluation patterns, the second marks of the cross-media misalignment evaluation patterns are a plurality of parallel lines.

7. The storage medium of claim 3, wherein:

the instructions to perform comprise instructions to:

after printing the first and second portions of the alignment patterns, pull the medium in a direction opposite the single printing direction with the printing device;

optically scan each of the first and second cross-media misalignment evaluation patterns; and determine the respective values of cross-media misalignment for the first and second portions of the printed alignment pattern based on the optical scanning of the first and second cross-media misalignment evaluation patterns; and the instructions to determine the DSHE effect value comprise instructions to determine the DSHE effect value based on a difference between the determined values of cross-media misalignment.

8. A printing device comprising:

a printbar, comprising a plurality of printhead dice, to print content on a medium in a single pass and in a single printing direction;

a pattern engine to cause the printbar to print first and second portions of an alignment pattern on the medium with adjacent printhead dice of the printbar in a single pass and printing direction and at a target speed;

wherein, due to a dynamic swath height error (DSHE) effect, supplemental content included in the second portion is to induce greater cross-media misalignment orthogonal to the printing direction in the printing of the second portion than in the printing of the first portion excluding the supplemental content;

a scan engine to perform, with a scan device, an optical scanning procedure on the printed alignment pattern to determine respective values for cross-media misalignment orthogonal to the printing direction for the first and second portions of the printed alignment pattern;

a determine engine to determine a DSHE effect value based on the determined cross-media misalignment values; and an estimate engine to, based on the determined DSHE effect value and the target print speed, estimate an amount of pen to paper spacing (PPS) at one of the adjacent printhead dice.

9. The printing device of claim 8, wherein:

the supplemental content is a wide solid fill pattern separated from and adjacent to other marks of the second portion of the alignment pattern; and the DSHE effect is orthogonal to the single printing direction.

10. The printing device of claim 8, wherein:

the patter engine is to print a first cross-media misalignment evaluation pattern of the first portion partially with a first die of the adjacent printhead dice and partially with a second die of the adjacent printhead dice;

the pattern engine is to print a second cross-media misalignment evaluation pattern of the second portion partially with the first die and partially with the second die; and the pattern engine is to print a wide solid fill pattern with the first die as the supplemental content of the second portion, parallel with the second cross-media misalignment evaluation pattern.

11. The printing device of claim 8, wherein the estimate engine is to estimate the amount of PPS at the one of the adjacent printhead dice based on PPS estimation information defining relationships between given DSHE effect values and print speeds, and respective PPS values.

12. The printing device of claim 8, wherein:

the pattern engine is further to print a respective instance of the alignment pattern with each of a plurality of pairs of adjacent printhead dice of the printbar;

the estimate engine is to, for each of the plurality of pairs of adjacent printhead dice, estimate an amount of PPS at one of the adjacent printhead dice based on the target print speed and an DSHE effect value determined based on the respective alignment pattern printed with the pair of adjacent printhead dice;

the estimate engine is further to derive a PPS evaluation value based on at least one of the estimated amounts of PPS; and the estimate engine is further to determine whether the PPS evaluation value is within a target PPS range.

13. A method of a printing device, the method comprising:

printing, on a medium, a first portion of an alignment pattern including a first cross-media misalignment evaluation pattern;

printing, on the medium, a second portion of the alignment pattern including a second cross-media misalignment evaluation pattern and supplemental content not included in the first portion, the supplemental content to induce greater cross-media misalignment when printed than the content of the first portion due to a dynamic swath height error (DSHE) effect;

wherein the first and second portions of the alignment pattern are printed with adjacent printhead dice of a printbar of the printing device in a single pass along the medium, in a single printing direction, and at a target speed;

performing an optical scanning procedure on the printed alignment pattern to determine respective values of cross-media misalignment, orthogonal to the single printing direction, for each of the first and second portions of the printed alignment pattern;

determining a DSHE effect value based on the determined cross-media misalignment values; and based on the determined DSHE effect value and the target print speed, estimating an amount of pen to paper spacing (PPS) at one of the adjacent printhead dice.

14. The method of claim 13, further comprising:

deriving a PPS evaluation value based on at least the estimated amount of PPS; and determining whether the PPS evaluation value is within a target PPS range.

15. The method of claim 14, further comprising:

determining to output either a first indication that the printing device has a suitable PPS or a second indication that the printing device PPS is to be adjusted, based on whether the PPS evaluation value is determined to be within the target PPS range.

* * * * *